US006127102A

United States Patent [19]

Geuens et al.

[11] Patent Number: 6,127,102

[45] Date of Patent: Oct. 3, 2000

[54] RECORDING MATERIAL WITH IMPROVED SHELF-LINE PRODUCING PRINTS UPON THERMAL DEVELOPMENT WITH IMPROVED ARCHIVABILITY

[75] Inventors: Ingrid Geuens, Emblem; Yvan Gilliams, Hever; Dirk Bollen, Sint-Truiden; Yvan Hoogmartens, Wilrijk; André Bellens, Pulle, all of Belgium

[73] Assignee: Agfa-Gevaert N.V., Mortsel, Belgium

[21] Appl. No.: 09/323,860

[22] Filed: Jun. 1, 1999

Related U.S. Application Data

[60] Provisional application No. 60/096,563, Aug. 13, 1998.

[30] Foreign Application Priority Data

Jun. 6, 1998 [EP] European Pat. Off. ..... 98201962

[51] Int. Cl.[7] ..... G03C 1/498

[52] U.S. Cl. ..... 430/350; 430/617; 430/618; 430/619; 430/620

[58] Field of Search ..... 430/350, 617, 430/619, 620, 618

[56] References Cited

U.S. PATENT DOCUMENTS 5,891,616 4/1999 Gilliams et al. ..... 430/617

FOREIGN PATENT DOCUMENTS 754969 1/1997 European Pat. Off. .
848286 6/1998 European Pat. Off. .

*Primary Examiner*—Thorl Chea
*Attorney, Agent, or Firm*—Baker Botts L.L.P.

[57] ABSTRACT

A recording material comprising a support and a thermosensitive element containing silver stearate, an organic reducing agent therefor in thermal working relationship therewith and a binder, wherein the silver stearate is not associated with mercury and/or lead ions and when the recording material is irradiated with a copper $K\alpha_1$ X-ray source the ratio of the sum of the peak heights of the X-ray diffraction lines attributable to silver stearate at Bragg angles, 2Θ, of 2Θ, of 3.62°, 5.45°, 7.30°, 9.04°, 10.97° and 12.71° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 2.2 $m/g^{0.5}$; and a process for producing particles of substantially light-insensitive organic silver salt comprising silver stearate with these X-ray characteristics in the substantial absence of organic solvent.

6 Claims, No Drawings

RECORDING MATERIAL WITH IMPROVED SHELF-LINE PRODUCING PRINTS UPON THERMAL DEVELOPMENT WITH IMPROVED ARCHIVABILITY

The application claims the benefit of U.S. Provisional Application No. 60/096,563, filed Aug. 13, 1998.

FIELD OF THE INVENTION

The present invention relates to recording materials with improved shelf-life and prints produced therewith with improved archivability.

BACKGROUND OF THE INVENTION

Thermal imaging or thermography is a recording process wherein images are generated by the use of thermal energy. Such recording materials become photothermographic upon incorporating a photosensitive agent which after exposure to UV, visible or IR light is capable of catalyzing or participating in a thermographic process bringing about changes in colour or optical density.

U.S. Pat. No. 4,273,723 discloses a process for preparing a silver salt of a fatty acid with 12 to 24 carbon atoms consisting essentially of reacting an alkali metal salt of the fatty acid with a water-soluble silver salt, and wherein the reaction is effected in a reaction system consisting essentially of (I) the alkali metal salt of the fatty acid, (II) the water-soluble silver salt, (III) at least one water-soluble or partially water-soluble $C_3$–$C_8$ alcohol and (IV) water, the volume ratio of the component (III) to the component (IV) being 1/5 to 5/1.

GB-A 1,378,734 discloses a process of producing a silver salt of an organic carboxylic acid conducted in the presence of a soluble mercury compound and/or a soluble lead compound.

EP-A 754 969 discloses a process for producing a suspension of particles containing a substantially light-insensitive silver salt of an organic carboxylic acid, comprising simultaneous metered addition of an aqueous solution or suspension of an organic carboxylic acid or its salt; and an aqueous solution of a silver salt to an aqueous liquid, wherein the metered addition of the aqueous solution or suspension of the organic carboxylic acid or its salt; and/or the aqueous solution of the silver salt is regulated by the concentration of silver ions or the concentration of anions of the silver salt in the aqueous liquid. Research Disclosure number 17029, published in June 1978, gives a survey of different methods of preparing organic heavy metal salts in section II.

The association of silver stearate with mercury or lead ions, particularly mercury ions, according to the teaching of GB 1,378,734, is environmentally undesirable and infringes governmental regulations.

Recording materials with prior art silver stearate exhibit poor shelf-life and prints produced therewith exhibit poor archivability, particularly as regards increase in $D_{max}$.

OBJECTS OF THE INVENTION

It is therefore an object of the invention to provide materials with an improved shelf-life.

It is a further object of the present invention to provide recording materials whose prints exhibit improved archivability.

It is a still further object of the present invention to provide production processes for substantially light-insensitive organic silver salt comprising silver stearate.

Further objects and advantages of the invention will become apparent from the description hereinafter.

SUMMARY OF THE INVENTION

Surprisingly it has been found that recording materials comprising a support and a thermosensitive element comprising silver stearate with a higher crystallinity than prior art silver stearate, an organic reducing agent therefor in thermal working relationship therewith and a binder exhibit a marked improvement in shelf-life and that prints produced therewith exhibit a marked improvement in archivability over prior art recording materials with silver stearate.

The above mentioned objects are realized with a recording material comprising a support and a thermosensitive element containing silver stearate, an organic reducing agent therefor in thermal working relationship therewith and a binder, wherein the silver stearate is not associated with mercury and/or lead ions and when the recording material is irradiated with a copper $K\alpha_1$ X-ray source the ratio of the sum of the peak heights of the X-ray diffraction lines attributable to silver stearate at Bragg angles, 2Θ, of 3.62°, 5.45°, 7.30°, 9.04°, 10.97° and 12.71° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 2.2 $m/g^{0.5}$.

A production process for a dispersion of particles of substantially light-insensitive organic silver salt containing silver stearate in a substantially solvent-free aqueous medium is further provided according to the present invention comprising the steps of: i) preparing an aqueous dispersion of one or more organic acids containing stearic acid and an anionic surfactant; ii) substantially neutralizing the organic acids with aqueous alkali thereby forming organic acid salts containing a stearic acid salt; (iii) adding an aqueous solution of a silver salt to convert completely the organic acid salt(s) into their silver salts containing silver stearate, wherein the anionic surfactant is present in a molar ratio with respect to organic acid greater than 0.15 and the silver salt is added to produce organic silver salt(s) at a rate between 0.025 mol/mol organic silver salt(s)•min and 2.25 mol/mol organic silver salt(s)•min.

Particles of substantially light-insensitive organic silver salt containing silver stearate producible according to the above-mentioned process are also provided.

A recording process is further provided according to the present invention comprising the steps of: (i) bringing an outermost layer of the above-mentioned recording material in proximity with a heat source; and (ii) applying heat from the heat source imagewise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

SUBSTANTIALLY

By substantially light-insensitive is meant not intentionally light sensitive. By the terms substantially solvent-free aqueous medium and in the substantial absence or organic solvent is meant that solvent, if present, is miscible with water and present in amounts below 10% by volume of the aqueous medium.

THERMOSENSITIVE ELEMENT

The thermosensitive element, according to the present invention, comprises silver stearate, an organic reducing agent therefor in thermal working relationship therewith and a binder. The element may comprise a layer system in which the ingredients may be dispersed in different layers, with the proviso that the two ingredients are in reactive association with one another i.e. during the thermal development process the reducing agent must be present in such a way that it is able to diffuse to the silver stearate so that reduction of silver stearate to silver can occur.

In a preferred embodiment of the present invention the thermosensitive element further comprises a photosensitive species capable upon exposure of forming a species capable of catalyzing reduction of the silver stearate.

SILVER STEARATE CHARACTERIZATION

The silver stearate in the recording material, of the present invention, is characterized in that when the recording material is irradiated with a copper $K\alpha_1$ X-ray source the ratio of the sum of the peak heights of the X-ray diffraction lines attributable to silver stearate at Bragg angles, 2Θ, of 3.62°, 5.45°, 7.30°, 9.04°, 10.97° and 12.71° to the sum of the peak heights of the X-ray diffraction lines at Bragg angles, 2Θ, of 25.60°, 35.16° and 43.40° of NIST (National Institute of Standards, Gaithersburg, Md. 20899-0001, U.S.A.) standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 2.2 $m/g^{0.5}$, which is referred to in the detailed description of the present invention as the crystallinity of silver stearate. In a preferred embodiment of the present invention, the crystallinity of silver stearate is greater than 3.0 $m/g^{0.5}$.

The crystallinity of the silver stearate in the recording material of the present invention is obtained by determining X-ray diffraction spectra on sheets of a particular recording material and of the NIST standard 1976 cut to fit the sample holder of the X-ray diffractometer used, subtracting the background using standard techniques, determining the peak heights (maxima) of the diffraction peaks, determining for the sample of recording material the sum of the peak heights (maxima), $K_{material}$, of the XRD lines attributable to silver stearate at Bragg angles, 2Θ, of 3.62°, 5.45°, 7.30°, 9.04°, 10.97° and 12.71°, determining for the sample of NIST standard 1976 the sum of the peak heights (maxima), $K_{1976}$, of the X-ray diffraction lines at Bragg angles, 2Θ, of 25.60°, 35.16° and 43.40°, calculating the ratio of $K_{material}/K_{1976}$ for the recording material, determining the concentration of silver $C_{Ag}$ present in the recording material in grams per square meter of material and finally normalizing the ratio $K_{material}/K_{1976}$ with $\sqrt{C_{Ag}}$ to give $K_{material}/(K_{1976}\times\sqrt{C_{ag}})$ which is a relative crystallinity for the silver stearate in the recording material concerned. The exact positions of the peaks attributable to silver stearate can vary within 0.3° of the angles given above. In such cases the peak height should be taken as the actual peak height of the peak and not the height of the peak at the angle given above.

The concentration of silver present in the recording material can be determined by any known technique e.g. non-destructive methods such as X-ray fluorescence and destructive methods such as dissolution of the silver salt followed by standard volumetric techniques for the determination of silver, such as described in R. Belcher and A. J. Nutten, Quantitative Inorganic Analysis, 2nd Edition, Butterworths, London (1960), pages 201–219.

ORGANIC SILVER SALT PARTICLES CONTAINING SILVER STEARATE

Organic silver salt particles containing silver stearate may contain up to 100 mol % of silver stearate. They preferably contain at least 50 mol % of silver stearate. Preferred substantially light-insensitive organic silver salts used in the present invention are silver salts of organic carboxylic acids for use in the recording materials of the present invention together with silver stearate are silver salts of other aliphatic carboxylic acids known as fatty acids, wherein the aliphatic carbon chain has preferably at least 12 C-atoms, e.g. silver laurate, silver stearate, silver hydroxystearate, silver behenate and silver arichidate. Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the present invention.

The silver stearate of the present invention is not associated with mercury and/or lead ions. This means that mercury/and or silver ions are not intentionally added at any point during the preparation process and therefore are not intentionally associated with the silver stearate in the recording material of the present invention.

PREPARATION OF AQUEOUS DISPERSIONS OF ORGANIC SILVER SALT PARTICLES CONTAINING SILVER STEARATE IN THE SUBSTANTIAL ABSENCE OF SOLVENT

A production process for a dispersion of particles of substantially light-insensitive organic silver salt containing silver stearate in a substantially solvent-free aqueous medium is provided according to the present invention comprising the steps of: i) preparing an aqueous dispersion of one or more organic acids containing stearic acid and an anionic surfactant; ii) substantially neutralizing the organic acids with aqueous alkali thereby forming organic acid salts containing a stearic acid salt; (iii) adding an aqueous solution of a silver salt to convert completely the organic acid salts into their silver salts containing silver stearate, wherein the anionic surfactant is present in a molar ratio with respect to organic acid greater than 0.15 and the silver salt is added to produce organic silver salt(s) at a rate between 0.025 mol/mol organic silver salt(s)•min and 2.25 mol/mol organic silver salt(s)•min. In preferred embodiments of the above production process the anionic surfactant is present in a molar ratio with respect to organic carboxylic acid greater than 0.25 and the silver salt is added at a rate between 0.03 mol/mol organic silver salt(s)•min and 0.7 mol/mol organic silver salt(s)•min, with a molar ratio of anionic surfactant with respect to organic acid greater than 0.3 and a rate of silver salt addition of between 0.04 mol/mol organic silver salt(s)•min and 0.3 mol/mol organic silver salt(s)•min being particularly preferred.

In a preferred embodiment, step (iii) of the production process of the present invention is carried out such that part of the solution of acid salts produced in step (ii) of the process is present in the reaction vessel prior to silver salt solution addition and part thereof is added simultaneously with the addition of the silver salt solution, with about 25 to 50% of the solution of acid salts produced in step (ii) being in the reaction vessel prior to silver salt addition being particularly preferred.

Preferred anionic surfactants for use in the above-mentioned process are alkali or ammonium salts of an acid selected from the group consisting of: alkylsulfonic acids, alkarylsulfonic acids, aralkylsulfonic acids, arylsulfonic acids, alkylsulfuric acids, aralkylsulfuric acids, arylsulfuric acids, alkarylsulfuric acids and organic carboxylic acids. Alkali or ammonium salts of alkylarylsulfonic acids are preferred with alkali or ammonium salts of alkylbenzene sulfonic acids being particularly preferred. Suitable anionic surfactants for use in the above-mentioned process are:

Surfactant Nr. 1=MARLON™ A-396, a sodium alkylphenylsulfonate from Hüls;

Surfactant Nr. 2=ERKANTOL™ BX, a sodium diisopropyl-naphthalenesulfonate from BAYER;

Surfactant Nr. 3=ULTRAVON™ W, a sodium arylsulfonate from Ciba-Geigy.

In the above-mentioned process the pH used is sufficiently low to avoid the oxidation of silver ions to silver oxide or silver hydroxide for which a pH below 10 is usually required, the process temperature is chosen such that it is above the melting point of the organic acid(s) used, about 70° C. in the case of stearic acid and the process is carried out with stirring, the stirring rate being dependent upon: the size of the stirrer relative to the reaction vessel, the type of stirrer used, avoidance of silver oxide or silver hydroxide formation due to insufficient mixing and avoidance of foaming, it being usually between 200 and 1000 rpm. Furthermore, a slight excess of an organic acid, for example 2 mol % of stearic acid, is preferred.

The size of the substantially light-insensitive organic silver salt particles containing silver stearate can be varied by varying the rate of silver salt addition, the concentration of anionic surfactant and the temperature, the equivalent diameter of the particles increasing with decreasing addition rate, decreasing anionic surfactant concentration and increasing temperature.

In a further preferred embodiment of the above-mentioned process the dispersion of particles of substantially light-insensitive organic silver salt containing silver stearate is subjected to ultrafiltration. The ultrafiltration process removes ionic species and concentrates the dispersion of substantially light-insensitive organic silver salt containing silver stearate by filtration through a cartridge-filter with a pore size sufficiently small to remove the salt produced upon the formation of the organic silver salt without removing the organic silver salt. Cartridge-filters with 10 000 to 500 000 MW have been found to be suitable for this purpose. In order to maintain the stability of the dispersion of substantially light-insensitive organic silver salt containing silver stearate during ultrafiltration it is necessary to maintain a minimum anionic surfactant concentration, but the counterion of the anionic surfactant can be changed, if the presence of the original counterion is undesirable in the recording material. For example the sodium ions in Surfactant nr 1 can be replaced by ammonium ions by washing with an ammonium nitrate solution during the ultrafiltration process and the sodium ion concentration reduced to below 100 ppm.

The above-mentioned process produces substantially light-insensitive organic silver salt particles containing silver stearate in which the silver stearate has a crystallinity, as defined above, greater than 2.2 $m/g^{0.5}$.

SUBSTANTIALLY LIGHT-INSENSITIVE ORGANIC SILVER SALT DISPERSIONS

In the case of dried particles of organic silver salt comprising silver stearate with higher crystallinity, as defined above, it has been found that recording materials, according to the present invention, can be produced, if dispersions thereof are produced using dispersion techniques in which the particles themselves are subjected to as little damage as possible commensurate with achieving a satisfactory dispersion quality e.g. using microfluidizers, ultrasonic apparatuses, rotor stator mixers etc.

REDUCING AGENTS

Suitable organic reducing agents for the reduction of organic silver salt particles containing silver stearate are organic compounds containing at least one active hydrogen atom linked to O, N or C, such as is the case with, aromatic di- and tri-hydroxy compounds. Catechol-type reducing agents, i.e. reducing agents containing at least one benzene nucleus with two hydroxy groups (—OH) in ortho-position, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters are preferred, with those described in EP-B 692 733 and EP-A 903 625 being particularly preferred.

Other suitable reducing agents, particularly for photothermographic recording materials, are sterically hindered phenols, bisphenols and sulfonamidophenols.

Combinations of reducing agents may also be used that on heating become reactive partners in the reduction of the substantially light-insensitive organic silver salt containing silver stearate. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; and 2-substituted malonodialdehyde compounds as disclosed in U.S. Pat. No. 5,654,130.

FILM-FORMING BINDERS OF THE THERMOSENSITIVE ELEMENT

The film-forming binder of the thermosensitive element containing organic silver salt particles containing silver stearate may be all kinds of natural, modified natural or synthetic resins or mixtures of such resins, in which the organic silver salt particles containing silver stearate can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The above mentioned binders or mixtures thereof may be used in conjunction with waxes or "heat solvents" also called "thermal solvents" or "thermosolvents" improving the reaction speed of the redox-reaction at elevated temperature.

TONING AGENT

In order to obtain a neutral black image tone in the higher densities and neutral grey in the lower densities the thermosensitive element contains preferably in admixture with the organic silver salt particles containing silver stearate and reducing agents a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB-P 1,439,478, U.S. Pat. Nos. 3,951,660 and 5,599,647.

STABILISERS AND ANTIFOGGANTS

In order to obtain improved shelf-life and reduced fogging, stabilizers and antifoggants may be incorporated into the recording materials of the present invention.

OTHER ADDITIVES

The recording material may contain in addition to the ingredients mentioned above other additives such as free fatty acids, additional surfactants, antistatic agents, e.g. non-ionic antistatic agents including a fluorocarbon group as e.g. in $F_3C(CF_2)_6CONH(CH_2CH_2O)$—H, silicone oil, e.g. BAYSILONE™ Öl A (from BAYER AG, GERMANY), ultraviolet light absorbing compounds, white light reflecting and/or ultraviolet radiation reflecting pigments and/or optical brightening agents.

SUPPORT

The support for the thermosensitive element according to the present invention may be transparent, translucent or opaque, e.g. having a white light reflecting aspect and is preferably a thin flexible carrier e.g. polypropylene, polycarbonate or polyester, e.g. polyethylene terephthalate.

The support may be in sheet, ribbon or web form and subbed if need be to improve the adherence to the thereon coated thermosensitive element. The support may be made of an opacified resin composition. Should a transparent base be used, the base may be colourless or coloured, e.g. having a blue colour. One or more backing layers may be provided to control physical properties such as curl and static.

OUTERMOST LAYER

The outermost layer of the recording material may in different embodiments of the present invention be the outermost layer of the thermosensitive element, a protective layer applied to the thermosensitive element or a layer on the opposite side of the support to the thermosensitive element.

PROTECTIVE LAYER

According to a preferred embodiment of the recording material, according to the present invention, the thermosensitive element is provided with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates as described in EP-A 614 769 are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

CROSSLINKING AGENTS FOR OUTERMOST LAYER

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethyl-orthosilicate and tetraethylorthosilicate being preferred.

MATTING AGENTS FOR OUTERMOST LAYER

The outermost layer of the recording material according to the present invention may comprise a matting agent. Suitable matting agents are described in WO 94/11198 and include e.g. talc particles and optionally protrude from the outermost layer.

LUBRICANTS FOR OUTERMOST LAYER

Solid or liquid lubricants or combinations thereof are suitable for improving the slip characteristics of the recording materials according to the present invention.

Solid lubricants which can be used according to the present invention are polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199.

Liquid lubricants which can be used according to the present invention according to the present invention are fatty acid esters such as glycerine trioleate, sorbitan monooleate and sorbitan trioleate, silicone oil derivatives and phosphoric acid derivatives.

PHOTOSENSITIVE SPECIES

A preferred photosensitive species capable upon exposure of forming species capable of catalyzing reduction of the silver stearate of the present invention is silver halide.

The photosensitive silver halide used in the present invention may be employed in a range of 0.1 to 100 mol percent;

preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromo-iodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

SPECTRAL SENSITIZERS

The thermosensitive element, according to the present invention, may contain an infra-red sensitizer, an ultra-violet light sensitizer or a visible light sensitizer. Suitable sensitizers include cyanine, merocyanine, styryl, hemicyanine, oxonol, hemioxonol and xanthene dyes. According to the present invention the thermosensitive element may further include a supersensitizer.

ANTIHALATION DYES

In addition to the ingredients, the recording materials used in the present invention may also contain antihalation or acutance dyes which absorb light which has passed through the photosensitive thermally developable photographic material, thereby preventing its reflection. Such dyes may be incorporated into the thermosensitive element or in any other layer of the recording material of the present invention.

COATING

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

THERMOGRAPHIC PROCESSING

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. Such thermal printing heads may be used in contact or close proximity with the recording material. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. The image-wise heating can be carried out such that heating elements not required to produce an image pixel generate an amount of heat ($H_e$) in accordance with the following formula: $0.5\ H_D<H_e<H_D$ wherein $H_D$ represents the minimum amount of heat required to cause visible image formation in the recording material.

EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

PHOTOTHERMOGRAPHIC PROCESSING

Photothermographic recording materials, according to the present invention, may be exposed with radiation of wavelength between an X-ray wavelength and a 5 microns wavelength with the image either being obtained by pixel-wise exposure with a finely focused light source, a UV, visible or IR wavelength laser or a light emitting diode or by direct exposure to the object itself or an image therefrom with appropriate illumination.

For the thermal development of image-wise exposed photo- thermographic recording materials, according to the present invention, any sort of heat source can be used that enables the recording materials to be uniformly heated to the development temperature in a time acceptable for the application concerned.

INDUSTRIAL APPLICATION

Thermographic and photothermographic imaging can be used for the production of transparencies and reflection type prints. Application of the present invention is envisaged in the fields of both graphics images requiring high contrast images with a very steep dependence of print density upon applied dot energy and continuous tone images requiring a weaker dependence of print density upon applied dot energy, such as required in the medical diagnostic field. In the hard copy field recording materials on a white opaque base are used, whereas in the medical diagnostic field black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

as organic silver salt:

AgSt=silver stearate;

as binders:

K7598=type K7598, a calcium-free gelatine from AGFA-GEVAERT GELATINEFABRIEK vorm. KOEPFF & SÖHNE;

K17881=type K17881, a calcium-free gelatine from AGFA-GEVAERT GELATINEFABRIEK vorm. KOEPFF & SÖHNE;

K16353=type K16353, a calcium-free high viscosity gelatine from AGFA-GEVAERT GELATINEFABRIEK vorm. KOEPFF & SÖHNE;

LATEX 01=a 24% by weight aqueous latex of a polymer produced by copolymerizing a monomer mixture consisting of 42% by weight of n-butyl acrylate, 53% by weight of styrene, 2% by weight of itaconic acid and 3% by weight of $CH_2{=}C(CH_3)CONH{-}(CH_2)_{10}{-}CONHC_6H_4{-}p{-}SO_3K$ followed by desalting and adjusting to pH 5.4 with ammonia;

as reducing agent:

R01=ethyl 3,4-dihydroxybenzoate;

as toning agent:

T01=7-(ethylcarbonato)-benzo[e][1,3]oxazine-2,4-dione (see formula I below)

(I)

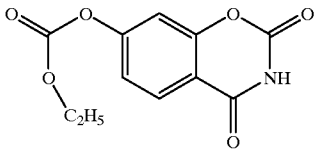

COMPARATIVE EXAMPLES 1 & 2

Preparation of prior art silver stearate according to RD 17029

In the preparation of Types I & II silver stearate, solution A was first prepared by adding 0.15 moles of solid sodium hydroxide to a dispersion of 0.1575 moles and 0.176 moles of stearic acid in 1 L of deionized water at 75° C. thereby producing a solution of sodium stearate with a pH of ca. 9. Solution B, 250 mL of 0.6M aqueous silver nitrate acidified with 0.4 g of 65% nitric acid at a temperature of 65° C., was then added with vigorous stirring to solution A in 15s while maintaining a temperature of 75° C. After 1 minute the resulting suspension of silver stearate was cooled to room temperature and had a pH of ca. 5 and a UAg of ca. 310 mV. The silver stearate was filtered off under reduced pressure, washed twice each time with about 5 L of deionized water and dried in a forced air drying cupboard at 40° C.

Preparation of silver stearate dispersions

The quantities of type I and type II silver stearates given in table 1 were dispersed with the quantities of deionized water and 10% solution of Surfactant Nr 1 given in table 1 first with an ULTRATURRAX™ mixer to obtain a predispersion and then through a MICROFLUIDICS™ M-110Y high pressure microfluidizer at a jet pressure of 350 bar to produce the final dispersions with concentrations of 11.5% and 11.3% respectively.

TABLE 1

| Comparative | silver stearate | | quantity of | quantity of 10% solution |
|---|---|---|---|---|
| example nr | type | quantity [g] | deionized water [g] | of Surfactant Nr 1 [g] |
| 1 | I | 58 | 342 | 100 |
| 2 | II | 60 | 340 | 100 |

Preparation of a tone modifier dispersion

The tone modifier dispersion was prepared by first dissolving 11 g of K7598 in 69 g of deionized water by first adding the gelatine, then allowing the gelatine to swell for 30 minutes and finally heating to 50° C. 20 g of T01 was added with ULTRATURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of T01 and 11% of gelatin.

Thermosensitive element

The thermosensitive emulsion was produced as follows: 2.341 g of K7598 was allowed to swell for 30 minutes with deionized water (for the quantity used in the preparation of the thermographic emulsion for the particular recording material see table 2) and the resulting gel heated to 36° C. The following ingredients were then added with stirring: 5.699 g of the tone modifier dispersion at 36° C., then 8.120 g of LATEX 01 followed by 5 minutes stirring, the corresponding silver stearate dispersion (for quantity and silver stearate concentration therein used for the thermosensitive emulsion for the particular recording material see table 2) followed by 5 minutes stirring, 12.35 g of a 10.95% ethanol solution of R01 at 45° C. and finally 2.880 g of a 3.7% aqueous solution of formaldehyde.

The thermosensitive dispersions were then doctor blade-coated onto a 175 μm subbed PET support and dried for 10 minutes at 50° C. thereby producing the thermosensitive elements of COMPARATIVE EXAMPLES 1 & 2.

TABLE 2

| Comparative | quantity of | silver stearate dispersion | | |
|---|---|---|---|---|
| example nr | water [g] | AgSt type | concentration (%) | quantity [g] |
| 1 | 20.140 | I | 11.504 | 37.470 |
| 2 | 20.450 | II | 11.298 | 38.160 |

Determination of silver stearate crystallinity in the recording materials

The crystallinity of the silver stearate in the recording materials of COMPARATIVE EXAMPLES 1 & 2 was determined as follows:

i) 30 mm diameter samples of the recording materials of COMPARATIVE EXAMPLES 1 & 2 and of NIST standard 1976 were cut from larger sheets using a punch;

ii) X-ray diffraction scans were then carried out using a SIEMENS D5000 X-ray diffractometer equipped with a copper $K\alpha_1$ X-ray source operating at 40 keV and a current of 30 mA with the samples in the sample holder thereof to scan the samples of COMPARATIVE EXAMPLES 1 & 2 and NIST standard 1976, with the same X-ray diffractometer in exactly the same state of adjustment, in steps of 0.05 degrees at a rate of 1 step/s between Bragg angles, 2Θ, of 2° and 50° and the data processed using SIEMENS DIFFRAC™ AT software to produce X-ray diffraction spectra corrected for background and exact peak heights (maxima) of each X-ray diffraction peak;

iii) the $K_{material}$ values were then determined for the recording materials of COMPARATIVE EXAMPLES 1 & 2 by adding up the peak heights (maxima) of the X-ray diffraction lines attributable to silver stearate at Bragg angles, 2Θ, of 3.62°, 5.45°, 7.30°, 9.04°, 10.97° and 12.71°;

iv) the $K_{1976}$ value was determined for NIST standard 1976 by adding up the peak heights (maxima) of the X-ray diffraction lines at Bragg angles, 2Θ, of 25.60°, 35.16° and 43.40°;

v) the weights of silver in g/m$^2$, $C_{Ag}$, of the recording materials of COMPARATIVE EXAMPLES 1 & 2 were determined using a PHILIPS PW2400 wavelength dispersive X-ray fluorescence apparatus with a chromium $K\alpha_1$ X-ray source operating at 60 keV and a current of 50 mA, which had been calibrated for silver using silver-containing samples for which the silver concentrations had been determined using standard volumetric titration techniques; and vi) the crystallinity values for the silver stearate present in the recording materials of COMPARATIVE EXAMPLES 1 & 2 were determined using the expression: $K_{material}/(K_{1976}\times\sqrt{C_{Ag}})$.

The crystallinity values for the silver stearate in the recording materials of COMPARATIVE EXAMPLES 1 & 2 are given in table 3.

Thermographic printing

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors, was 1.6 mJ/dot and was sufficient to obtain maximum optical density in the thermographic recording materials of COMPARATIVE EXAMPLES 1 & 2.

During printing of the recording materials of COMPARATIVE EXAMPLES 1 & 2 the printhead was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The maximum densities, $D_{max}$, and minimum densities, $D_{min}$, of the prints given in table 3 were measured through a visible filter with a MACBETH™ TR924 densitometer in the grey scale steps corresponding to data levels of 64 and 0 respectively and are given in table 3 for COMPARATIVE EXAMPLES 1 & 2.

Shelf-life test

The shelf-life of the recording materials of COMPARATIVE EXAMPLES 1 & 2 was evaluated on the basis of the observed changes in minimum and maximum density measured through a visible filter using a MACBETH™ TR924 densitometer upon thermographic printing after heating the recording materials at 57° C. in a relative humidity of 34% for 3 days in the dark. The results are given in table 3.

Archivability test

The achivability of prints made with the recording materials of COMPARATIVE EXAMPLES 1 & 2 was evaluated on the basis of the changes in minimum and maximum density, $D_{min}$ and $D_{max}$, measured through a visible filter using a MACBETH™ TR924 densitometer upon heating the prints at 57° C. in a relative humidity (RH) of 34% for 3 days in the dark. The results are given in table 3.

TABLE 3

| Comparative example number | Silver stearate coating type | weight [g/m$^2$] | crystallinity | fresh print characteristics $D_{max}$ (vis) | $D_{min}$ (vis) | archivability $\Delta D_{max}/D_{min}$ (vis) after 3 d at 57° C./34% RV | shelf-life $\Delta D_{max}/D_{min}$ (vis) after 3 d at 57° C./34% RV |
|---|---|---|---|---|---|---|---|
| 1 | I | 3.99 | 2.01 | 3.20 | 0.08 | +0.43/0.00 | +0.51/0.00 |
| 2 | II | 3.66 | 1.44 | 3.21 | 0.07 | +0.46/+0.01 | +0.55/+0.02 |

COMPARATIVE EXAMPLE 3

Preparation of prior art silver stearate according to EP-A 754 969

A sodium stearate solution was prepared by dissolving with stirring 27.0 g of sodium stearate in a mixture of 80 mL of 2-propanol and 285.5 mL of deionized water at 75° C. to give a 7.19% by weight solution.

The silver stearate synthesis was carried out at a constant UAg of 400 mV as follows: to a stirred solution of 30 g of K17881 in 1000 mL of distilled water at 71° C. in a double walled reactor, several drops of a 2.94M aqueous solution of silver nitrate were added to adjust the UAg at the start of the reaction to 400 mV and then 340 g of the above-mentioned sodium stearate solution at a temperature of 75° C. was metered into the reactor at a rate of 48 mL/min and simultaneously a 3.792% by weight aqueous solution of silver nitrate was metered into the reactor, its addition rate being controlled by the quantity of the silver nitrate solution necessary to maintain a UAg of 400±5 mV in the dispersing medium in the reactor. Both the sodium stearate and silver nitrate solutions were added to the dispersing medium via small diameter tubes positioned just under the surface of the dispersing medium. By the end of the addition step 0.080 moles of sodium behenate and 0.087 moles of silver nitrate had been added. The mixture was then stirred for a further 30 minutes. The resulting silver stearate dispersion contained 1.79% by weight of silver behenate and 1.72% by weight of K17881.

5 g of K16353 was added per 100 g of silver stearate dispersion together with 6% of Surfactant Nr. 3 and the resulting dispersion doctor blade coated to a silver stearate coverage of 0.98 g/m$^2$ after drying. The crystallinity of the silver stearate in the resulting material was determined as described for COMPARATIVE EXAMPLES 1 & 2 to be 1.80, see table 4.

TABLE 4

| | Silver stearate | | |
|---|---|---|---|
| Comparative example number | type | coating weight [g/m$^2$] | crystallinity |
| 3 | VI | 0.98 | 1.80 |

Therefore the silver salt production process of EP-A 754 969 produces silver stearate with a crystallinity, as determined according to the present invention, below 2.2 m/g$^{0.5}$ and hence outside the disclosure of the present invention.

INVENTION EXAMPLES 1 to 3

Preparation of silver stearate dispersions in an aqueous medium in the absence of organic solvent using a single jet process Aqueous dispersions of the silver stearate types III to V were produced as follows:

i) dispersing stearic acid (for quantity see table 5) with stirring at a given temperature (see table 5) in a mixture of deionized water (for quantity see table 5) and a 10% solution of Surfactant Nr 1 (for quantity see table 5) to produce a dispersion with a pH of about 4.2;

ii) then adding a quantity of 2M aqueous sodium hydroxide (for quantity see table 5) at the same temperature as the stearic acid dispersion with stirring over a particular time (see table 5 for the time of addition) thereby producing a clear solution with a pH of about 9.2 substantially containing sodium stearate;

iii) then metered addition of a particular quantity of an aqueous 1M silver nitrate solution (same quantity in moles as for sodium hydroxide) at the same temperature as the stearic acid dispersion with stirring at a particular rate (for rate given as moles/moles silver stearate•min see table 5) to convert the sodium stearate completely into silver stearate as a dispersion with a pH and UAg as given in table 5; and iv) ultrafiltration with a 500000 MW polysulfone cartridge filter at room temperature to concentrate the resulting silver stearate dispersion (final AgSt-concentration and residual conductivity in mS/cm are given in table 6).

The volume average particle size as determined by a Coulter LS230 diffractometer is also given in table 6.

TABLE 5

| Invention example number | AgSt type | quantity of stearic acid [moles] | quantity of deionized water [L] | quantity of 10% sol. of Surfactant Nr 1 [L] | temperature [° C.] | quantity of NaOH & $AgNO_3$ [moles] | addition time of 2M NaOH [min] | mol $AgNO_3$/mol AgSt · min | pH | UAg [mV] |
|---|---|---|---|---|---|---|---|---|---|---|
| 1 | III | 1.507 | 2.495 | 2.027 | 80 | 1.477 | 9.75 | 0.0650 | 6.61 | +314 |
| 2 | IV | 0.4 | 0.662 | 0.538 | 70 | 0.392 | 10 | 0.25 | 5.84 | +464 |
| 3 | V | 0.4 | 0.893 | 0.307 | 70 | 0.392 | 10 | 0.25 | 7.05 | +310 |

TABLE 6

| | | ultrafiltration | | |
|---|---|---|---|---|
| Invention example nr | AgSt type | residual conductivity [mS/cm] | % AgSt dispersion | average particle size [nm] |
| 1 | III | 3.2 | 16.86 | 339 |
| 2 | IV | 3.4 | 18.56 | |
| 3 | V | 2.0 | 19.31 | 3381 |

These dispersions of silver stearate were directly used in the preparation of the recording materials of INVENTION EXAMPLES 1 to 3.

Thermosensitive element

The thermosensitive elements of the recording materials of INVENTION EXAMPLES 1 to 3 were produced as described for the thermosensitive elements of the recording materials of COMPARATIVE EXAMPLES 1 & 2 except that the quantity of deionized water, the silver stearate type, concentration and quantity of dispersion used were as given in table 7 below.

TABLE 7

| Invention | quantity of | silver stearate dispersion | | |
|---|---|---|---|---|
| example nr | water [g] | AgSt type | concentration (%) | quantity [g] |
| 1 | 13.078 | III | 16.86 | 25.532 |
| 2 | 15.380 | IV | 18.56 | 23.230 |
| 3 | 16.290 | V | 19.31 | 22.320 |

The crystallinity values for the silver stearate in the recording materials of INVENTION EXAMPLES 1 to 3 determined as described for COMPARATIVE EXAMPLE 1 & 2 are given in table 8.

Thermographic evaluation

Thermographic printing with the recording materials of INVENTION EXAMPLES 1 to 3 and the evaluation thereof were carried out as described for the recording material of COMPARATIVE EXAMPLES 1 & 2. The results are summarized in table 8.

TABLE 8

| Invention example number | Silver stearate coating type | weight [g/m²] | crystal-linity | fresh print characteristics $D_{max}$ (vis) | $D_{min}$ (vis) | archivability $\Delta D_{max}/\Delta D_{min}$ (vis) after 3 d at 57° C./34% RV | shelf-life $\Delta D_{max}/\Delta D_{min}$ (vis) after 3 d at 57° C./34% RV |
|---|---|---|---|---|---|---|---|
| 1 | III | 3.37 | 2.48 | 3.24 | 0.07 | +0.25/0.00 | +0.19/0.00 |
| 2 | IV | 3.12 | 3.51 | 3.12 | 0.07 | +0.17/+0.01 | −0.19/0.00 |
| 3 | V | 3.81 | 3.16 | 3.38 | 0.07 | +0.24/+0.01 | −0.14/+0.01 |

These results show a considerable improvement in the shelf-life of recording materials of INVENTION EXAMPLES 1 to 3 and in the archivability of prints made therewith compared with the prior art recording materials of COMPARATIVE EXAMPLES 1 & 2 as demonstrated by a reduced increase in $D_{max}$ while maintaining $D_{min}$-stability. The recording materials of INVENTION EXAMPLES 1 to 3 only differ from those of COMPARATIVE EXAMPLES 1 & 2 in that they contain silver stearate with an increased crystallinity. This demonstrates the beneficial effect of increased silver stearate crystallinity on the stability of recording materials.

COMPARATIVE EXAMPLE 4 & INVENTION EXAMPLE 4

The photothermographic recording materials of COMPARATIVE EXAMPLE 4 & INVENTION EXAMPLE 4 were prepared using the aqueous dispersions of type II and type IV silver stearate respectively prepared as described for COMPARATIVE EXAMPLE 2 and INVENTION EXAMPLE 2 respectively.

Photo-addressable thermally developable elements

The photo-addressable thermally developable element was produced as follows: 2.1 g of K7598 was allowed to swell for 30 minutes in 8.4 g of deionized water and the resulting gel heated to 36° C., then with stirring the following ingredients were added: 2.5 g of an aqueous gelatinous emulsion of $AgBr_{0.97}I_{0.03}$ (6% by weight in gelatin and 13.36% by weight in $AgBr_{0.97}I_{0.03}$), silver stearate dispersion (for the quantity and concentration, see table 9), adjustment of the dispersion pH to 5.20 by addition of 1.25 g of nitric acid, 2.240 g of a 5.26% methanol solution of trimethylphenylammonium bromide perbromide, 9.804 g of a 21.4% aqueous dispersion of LATEX01, 1.606 g of an aqueous solution containing 18.68% of tribromomethylphenylsulfone, 9.3% of K7598 and 0.93% of Surfactant Nr 1 and finally 12.22 g of a dispersion of 17.82% LOWINOX™, 1.98% of Surfactant Nr 2 and 4.95% of phthalazine. The resulting dispersions were then doctor blade-coated onto a 175 μm subbed PET support and dried for 10 minutes at 50° C. to produce the photo-addressable thermally developable elements of the photothermographic recording materials of COMPARATIVE EXAMPLE 4 & INVENTION EXAMPLE 4 with a silver stearate coating weight of about 5.7 g/m². These photo-addressable thermally developable elements were then overcoated using a 50 μm doctor blade with 45 g of an aqueous solution consisting of 6.67% of K7598, 0.44% of 4-methylphthalic acid and 4.44% of the ammonium salt of perfluoro-octanoic acid to produce, after drying at 50° C. for 10 minutes, the photothermographic recording materials of COMPARATIVE EXAMPLE 4 & INVENTION EXAMPLE 4.

TABLE 9

| | silver stearate dispersion AgSt type | concentration [%] | quantity [g] |
|---|---|---|---|
| COMPARATIVE EXAMPLE 4 | II | 11.298 | 50.612 |
| Invention Example 4 | IV | 18.531 | 30.808 |

The crystallinity values for the silver stearate present in the photothermographic recording materials of COMPARATIVE EXAMPLE 4 & INVENTION EXAMPLE 4 determined as described for COMPARATIVE EXAMPLES 1 & 2 are given in table 10.

Photothermographic evaluation

The photothermographic recording materials of COMPARATIVE EXAMPLE 4 & INVENTION EXAMPLE 4 were then exposed to ultra-violet light through a test original in contact with the material in an AGFA-GEVAERT™ DL 1000 exposure apparatus followed by heating on a heated metal block for the times and at the temperatures given in Table 10 to produce a good image. The maximum densities, $D_{max}$, and minimum densities, $D_{min}$, of fresh prints measured through a UV-filter and through a visible filter with a MACBETH™ TD905 densitometer in the grey scale steps corresponding to data levels of 64 and 0 respectively and are given for the photothermographic recording materials COMPARATIVE EXAMPLE 4 & INVENTION EXAMPLE 4 in tables 10 and 11 respectively.

Shelf-life test

The shelf-life of the recording materials of COMPARATIVE EXAMPLE 4 & INVENTION EXAMPLE 4 was evaluated on the basis of the changes in minimum and maximum density measured through a UV-filter and through a visible filter using a MACBETH™ TD905 densitometer upon thermographic printing after heating the recording materials at 35° C. in a relative humidity of 80% for 3 days in the dark. The results are given in tables 10 and 11 respectively.

Light box test

The stability of unprocessed sheets of the photothermographic recording materials of COMPARATIVE EXAMPLE 4 & INVENTION EXAMPLE 4 to room lighting was evaluated on the basis of the change in density measured through a UV filter using a MACBETH™ TD905 densitometer upon exposure on top of the white PVC window of a specially constructed light-box placed for 3 days in a Votsch conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in tables 10 and 11.

TABLE 10

| Comparative example number | Silver stearate type | coating weight [g/m²] | crystal-linity | fresh print characteristics upon printing for 10 s at 105° C. $D_{max}$ (UV) | $D_{min}$ (UV) | light box $\Delta D_{mx}$ (UV) after 3 d at 30° C./85% RH Unprocessed sheets | shelf-life in dark $\Delta D_{max}/\Delta D_{min}$ (UV) after 3 d at 35° C./80% RH for printing at 105° C./10 s |
|---|---|---|---|---|---|---|---|
| 4 | II | 5.55 | 1.76 | 4.95 | 0.25 | 0.55 | −0.70/−0.02 |
| Invention example nr | | | | | | | for printing at 110° C./10 s |
| 4 | IV | 4.93 | 3.61 | 3.41 | 0.19 | 0.17 | −0.18/−0.17 |

TABLE 11

| Comparative example number | Silver stearate type | coating weight [g/m²] | crystal-linity | fresh print character- for 10 s at 105° C. $D_{max}$ (VIS) | $D_{min}$ (VIS) | shelf-life in dark $\Delta D_{max}/\Delta D_{min}$ (vis) after 3 d at 35° C./80% RH for printing at 105° C./10 s |
|---|---|---|---|---|---|---|
| 4 | II | 5.55 | 1.76 | 1.45 | 0.08 | −0.23/−0.02 |
| Invention example nr | | | | | | for printing at 110° C./10 s |
| 4 | IV | 4.93 | 3.61 | 2.13 | 0.12 | −0.06/−0.10 |

The results in tables 10 and 11 show a considerable improvement in the shelf-life stability of the photothermographic recording material of INVENTION EXAMPLES 4 compared with the photothermographic recording material of COMPARATIVE EXAMPLE 4 using prior art silver stearate as demonstrated by a reduced increase in $D_{max}$ while maintaining $D_{min}$-stability as measured both through a UV-filter and through a visible filter. The results in table 10 also show an increased stability of the photothermographic recording material of INVENTION EXAMPLE 4 to room lighting compared with the photothermographic recording material of COMPARATIVE EXAMPLE 4 using prior art silver stearate, as shown by a reduced increase in density measured through a UV-filter. The optical density measured through a UV-filter is relevant to the use of photothermographic materials for copying purposes in which UV-light is used. The photothermographic recording material of INVENTION EXAMPLE 4 only differs from that of COMPARATIVE EXAMPLE 4 in that it contains silver stearate with an increased crystallinity. This demonstrates the beneficial effect of increased silver stearate crystallinity on the stability of photothermographic recording materials.

Having described in detail preferred embodiments of the current invention, it will now be apparent to those skilled in the art that numerous modifications can be made therein without departing from the scope of the invention as defined in the following claims.

What is claimed is:

1. A recording material comprising a support and a thermosensitive element comprising silver stearate, an organic reducing agent therefor in thermal working relationship therewith and a binder, wherein said silver stearate is not associated with mercury and/or lead ions and when said recording material is irradiated with a copper $K\alpha_1$ X-ray source the ratio of the sum of the peak heights of the X-ray diffraction lines attributable to silver stearate at Bragg angles, 2Θ, of 3.62°, 5.45°, 7.30°, 9.04°, 10.97° and 12.71° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of said recording material and a sample of said NIST standard 1976 cut to fit a sample holder of said X-ray diffractometer, divided by the square root of the quantity of silver in said recording material, expressed in g per m², is greater than 2.2 $m/g^{0.5}$.

2. Recording material according to claim 1, wherein said ratio divided by the square root of the quantity of silver in said recording material expressed in g per $m^2$ is greater than 3.0 $m/g^{0.5}$.

3. Recording material according to claim 1, wherein said thermosensitive element is provided with a protective layer.

4. Recording material according to claim 1, wherein said thermosensitive element further comprises a photosensitive species capable upon exposure of forming a species capable of catalyzing reduction of said silver stearate.

5. A recording process comprising the steps of: (i) bringing an outermost layer of a recording material including a support and a thermosensitive element containing silver stearate, an organic reducing agent therefor in thermal working relationship therewith and a binder, into proximity with a heat source; and (ii) applying heat from said heat source imagewise to said recording material while maintaining proximity to said heat source to produce an image; and (iii) removing said recording material from said heat source, wherein said silver stearate is not associated with mercury and/or lead ions and when said recording material is irradiated with a copper $K\alpha_1$ X-ray source the ratio of the sum of the peak heights of the X-ray diffraction lines attributable to silver stearate at Bragg angles, 2Θ, of 3.62°, 5.45°, 7.30°, 9.04°, 10.97° and 12.71° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of said recording material and a sample of said NIST standard 1976 cut to fit a sample holder of said X-ray diffractometer, divided by the square root of the quantity of silver in said recording material, expressed in g per $m^2$, is greater than 2.2 $m/g^{0.5}$.

6. Recording process according to claim 5, wherein said heat source is a thin film thermal head.

* * * * *